US010174752B2

(12) United States Patent
Downing

(10) Patent No.: US 10,174,752 B2
(45) Date of Patent: Jan. 8, 2019

(54) ANTI-GAS LOCK VALVE FOR A RECIPROCATING DOWNHOLE PUMP

(71) Applicant: INNOVATIVE OILFIELD CONSULTANTS LTD., Calgary (CA)

(72) Inventor: Donald R Downing, San Antonio, TX (US)

(73) Assignee: Innovative Oilfield Consultants LTD Operating as Conn Pumps (CA)

( * ) Notice: Subject to any disclaimer, the term of this patent is extended or adjusted under 35 U.S.C. 154(b) by 498 days.

(21) Appl. No.: 14/761,333

(22) PCT Filed: Jan. 17, 2014

(86) PCT No.: PCT/CA2014/050032

§ 371 (c)(1),
(2) Date: Jul. 16, 2015

(87) PCT Pub. No.: WO2014/110681

PCT Pub. Date: Jul. 24, 2014

(65) Prior Publication Data

US 2015/0376996 A1 Dec. 31, 2015

Related U.S. Application Data

(60) Provisional application No. 61/753,494, filed on Jan. 17, 2013.

(51) Int. Cl.
*F04B 47/00* (2006.01)
*F04B 53/12* (2006.01)
(Continued)

(52) U.S. Cl.
CPC ..... *F04B 47/00* (2013.01); *E21B 34/12* (2013.01); *E21B 43/126* (2013.01);
(Continued)

(58) Field of Classification Search
CPC ..... F04B 19/22; F04B 53/12; F04B 7/0069; F04B 7/008; F04B 23/023; F04B 39/08;
(Continued)

(56) References Cited

U.S. PATENT DOCUMENTS 243,438 A 6/1881 Dunlap
2,933,050 A * 4/1960 Crowl ..... F04B 53/126 417/456

(Continued)

FOREIGN PATENT DOCUMENTS

CA 2069831 A1 5/1992

OTHER PUBLICATIONS

International Search Report for PCT/CA2014/050032 dated Apr. 16, 2014, 3 pp.

*Primary Examiner* — Bryan Lettman
*Assistant Examiner* — Timothy P Solak
(74) *Attorney, Agent, or Firm* — James A. Sheridan; Sheridan Law, LLC

(57) ABSTRACT

Method and apparatus overcoming gas-lock in reciprocating downhole pumps. On the downstroke of a plunger in a barrel, gassy fluid is compressed in the pump chamber between standing and travelling valves. Downhole plunger movement drags a sleeve over a mandrel for opening a chamber valve to a staging chamber located at a downhole end of the travelling valve for receiving at least a portion of the compressed and gassy fluid therein. On the upstroke, the chamber valve is dragged closed for sealably retaining the compressed gassy fluid therein while drawing an additional increment of fluid through the standing valve into the pump chamber. Continued downstroke and upstroke cycles increases pressure of the compressed gassy fluid in the pump chamber until it exceeds the hydrostatic head above the travelling valve for resumption of normal fluid pumping.

10 Claims, 5 Drawing Sheets

(51) Int. Cl.

| | |
|---|---|
| ***F04B 47/02*** | (2006.01) |
| ***F04B 19/22*** | (2006.01) |
| ***F04B 17/00*** | (2006.01) |
| ***F04B 23/02*** | (2006.01) |
| ***F04B 39/08*** | (2006.01) |
| ***F04B 53/10*** | (2006.01) |
| ***E21B 34/00*** | (2006.01) |
| ***E21B 43/12*** | (2006.01) |
| ***F04B 7/00*** | (2006.01) |
| ***E21B 34/12*** | (2006.01) |

(52) U.S. Cl.
CPC ..... *E21B 43/127* (2013.01); *F04B 7/008* (2013.01); *F04B 7/0069* (2013.01); *F04B 19/22* (2013.01); *F04B 23/023* (2013.01); *F04B 39/08* (2013.01); *F04B 47/02* (2013.01); *F04B 53/1005* (2013.01); *F04B 53/12* (2013.01); *E21B 2034/007* (2013.01); *F04B 2205/503* (2013.01)

(58) Field of Classification Search
CPC .... F04B 47/06; F04B 53/1005; F04B 53/125; F04B 53/141; F04B 2205/503; E21B 43/127
See application file for complete search history.

(56) References Cited

U.S. PATENT DOCUMENTS

| | | | | | |
|---|---|---|---|---|---|
| 3,162,143 | A * | 12/1964 | Ferguson | F04B 47/00 | 417/459 |
| 3,267,872 | A * | 8/1966 | Bloudoff | F04B 47/00 | 417/259 |
| 4,504,199 | A | 3/1985 | Spears | | |
| 4,867,242 | A | 9/1989 | Hart | | |
| 5,108,272 | A * | 4/1992 | Brewer | F04B 47/02 | 417/520 |
| 5,139,398 | A | 8/1992 | Downing | | |
| 5,915,478 | A | 6/1999 | Brown et al. | | |
| 6,481,987 | B2 | 11/2002 | Ford | | |
| 6,905,114 | B2 | 6/2005 | Ford | | |
| 7,008,197 | B2 | 3/2006 | Ford | | |
| 7,404,702 | B2 | 7/2008 | Ford | | |
| 7,428,923 | B2 | 9/2008 | Ford | | |
| 7,703,509 | B2 | 4/2010 | Ford | | |
| 7,713,035 | B2 | 5/2010 | Ford | | |
| 7,878,767 | B2 | 2/2011 | Ford | | |
| 2005/0022663 | A1 | 2/2005 | Ford | | |
| 2005/0025629 | A1 | 2/2005 | Ford | | |
| 2005/0226752 | A1 * | 10/2005 | Brown | F04B 47/02 | 417/555.1 |
| 2005/0252660 | A1 * | 11/2005 | Hughes | E21B 34/12 | 166/334.2 |
| 2008/0179560 | A1 | 7/2008 | Ford | | |
| 2008/0217565 | A1 | 9/2008 | Ford | | |
| 2009/0053087 | A1 | 2/2009 | Ford | | |
| 2010/0108150 | A1 | 5/2010 | Ford | | |
| 2010/0269928 | A1 | 10/2010 | Ford | | |
| 2010/0294731 | A1 | 11/2010 | Ford | | |
| 2011/0024112 | A1 | 2/2011 | Ford | | |
| 2011/0024370 | A1 | 2/2011 | Ford | | |
| 2011/0100624 | A1 | 5/2011 | Ford | | |

* cited by examiner

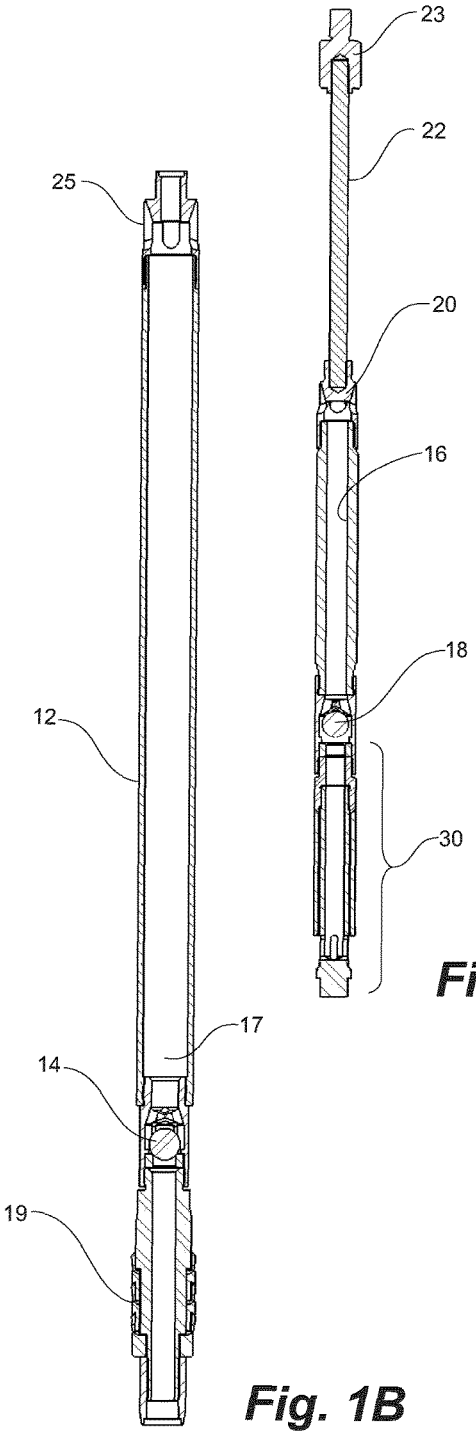
Fig. 1C
Fig. 1B
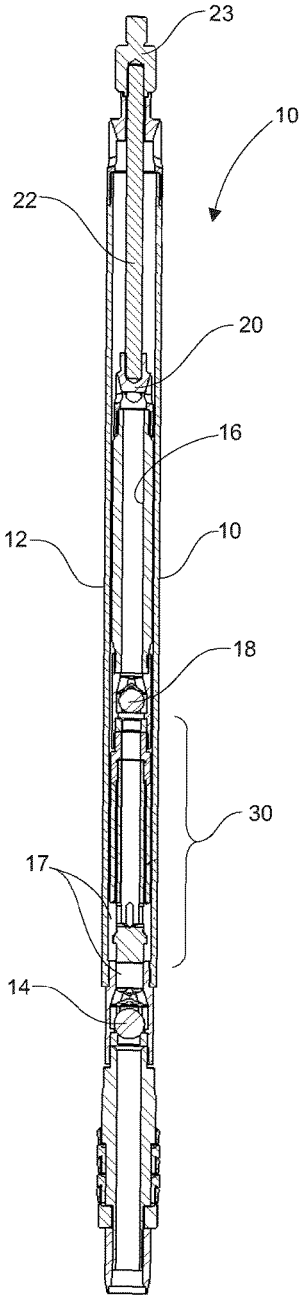
Fig. 1A

ANTI-GAS LOCK VALVE FOR A RECIPROCATING DOWNHOLE PUMP

FIELD OF THE INVENTION

This invention relates to downhole reciprocating pumps and more particularly to apparatus to minimize or overcome gas-locking.

BACKGROUND OF THE INVENTION

When an oil well is first drilled and completed, the fluids (such as crude oil) may be under natural pressure which is sufficient to produce on its own. In other words, the oil rises to the surface without any assistance.

In many oil wells, and particularly those in fields that are established and aging, natural pressure has typically declined to the point where the oil must be artificially lifted to the surface. Subsurface pumps are located in the well below the level of the oil. A string of sucker rods extends from the pump up to the surface to a pump jack device, or beam pump unit. A prime mover, such as a gasoline or diesel engine, or an electric motor, on the surface causes a pivoted walking beam of a pump jack to rock back and forth, one end connected to a string of sucker rods for moving or reciprocating the string up and down inside of the well tubing.

The string of sucker rods operates the subsurface pump. A typical pump has a plunger that is reciprocated inside of a pump barrel by the sucker rods. The barrel has a standing one-way valve adjacent a downhole end, while the plunger also has a one-way valve, called a travelling valve. Alternatively, in some pumps the plunger has a standing one-way valve, while the barrel has a traveling one-way valve. Relative movement alternatively charges the pump chamber, between the standing and travelling valves, with a bolus or increment of liquid and then transfers the bolus of liquid uphole. More specifically, reciprocation charges a compression pump chamber between the valves with fluid and then lifts the fluid up the tubing towards the surface. The one-way valves open and close according to pressure differentials across the valves.

Pumps are generally classified as tubing pumps or insert pumps. A tubing pump includes a pump barrel which is attached to the end joint of the well tubing. The plunger is attached to the end of the rod string and inserted down the well tubing and into the barrel. Tubing pumps are generally used in wells with high fluid volumes. An insert pump has a smaller diameter and is attached to the end of the rod string and run inside of the well tubing to the bottom. The non-reciprocating component is held in place by a hold-down device that seats into a seating nipple installed on the tubing. The hold-down device also provides a fluid seal between the non-reciprocating barrel and the tubing.

Volumetric efficiency of a pump is reduced in wells that have gas. The compression chamber between the standing and traveling one-way valves fails to fill completely with liquid. Instead, the compression chamber contains undissolved gas, air or vacuum, which are collectively referred to herein as "gas".

The gas may be undissolved from the liquid ("free gas") or it may be dissolved in the liquid ("solution gas") until subjected to a drop in pressure in an expanding compression chamber, wherein the gas comes out of solution. Gas takes the place of liquid in the compression chamber, reducing efficiency. The presence of gas in the compression chamber reduces the efficiency of the pump, and lifting costs to produce the liquid to the surface are increased. This condition is known as "gas interference".

The presence of too much gas in the compression chamber can completely eliminate the ability of the pump to lift fluid. This is because the gas in the compression chamber prevents the contents therein from being compressed enough, to a pressure high enough, to overcome the hydrostatic pressure above on the traveling valve. This condition is known as "gas locked", and is a type of gas interference.

In common field practice, a common method to break a gas lock in a conventional pump is to adjust the spacing of the pump setting, placing the bottom of the stroke into an interference state during reciprocation, and tag or impact the pump hard on the downstroke. This is done in an effort to jar the valve open so as to break a gas lock. Hitting the pump to open the valves causes damage to pump components and the rod string. Other prior art attempts to solve the gas lock problem have concentrated on the valves and the compression of a gas in the compression chamber.

Operating the pump in a gas locked condition is undesirable because energy is wasted in that the pump is reciprocated but no fluid is lifted. The pump, sucker rod string, surface pumping unit, gear boxes and beam bearings can experience mechanical damage due to the downhole pump plunger hitting the liquid-gas interface in the compression chamber on the downstroke. Loss of liquid lift leads to rapid wear on pump components, as well as stuffing box seals. This is because these components are designed to be lubricated and cooled by the well liquid.

Gas-locking, and implementation of a prior art solution for overcoming same, not only damages the pump and stuffing box, but can reduce the overall productivity of the well. Producing gas without the liquid component removes the gas from the well. The gas is needed to drive the liquid from the formation into the well bore.

Still another problem arises in the Texas Panhandle of the United States, where some oil fields have a minimum gas-to-oil ratio production requirement. In other words, both gas and oil must be produced. Many gas wells are unable to produce gas at their full potential because the downhole pumps are unable to lift the liquid oil, as the pumps are essentially gas locked.

Still another problem arises in stripper wells, which are wells that produce ten barrels or less of liquid each day. Stripper wells are low volume wells. The output from a stripper well is produced into a stock tank on the surface. Separation equipment, which separates the gas from the well, is not used because the production volume is too low to justify the expense of separation equipment. The gas is vented off of the stock tank into the atmosphere, contributing to air pollution and a waste of natural gas.

Still another problem arises in wells with little or no "rat hole". The rat hole is the distance between the deepest oil, gas and/or water producing zones and the plugged back, or deepest, depth of the well bore. Conventional downhole pumps cannot pump these wells to their full potential due to the low working submergence of the pump in the fluid. The low submergence results in both liquid and gas being sucked into the compression chamber. If insufficient volumes of liquid are drawn in, the pump is gas locked. In low volume wells, the common practice is to shut the pump off for a period of time to allow the liquid to enter the well bore. But, in wells with little or no rat hole, shutting the pump off has no effect because the liquid level is low. Deepening the well bore is typically too expensive. These wells contain oil, but cannot be produced with prior art pumps.

There are, however, many wells which produce fluids having a high gas content. The pumping efficiency of conventional pumps, as hereinabove discussed, is considerably reduced, and pumping action can be completely blocked. While a liquid is substantially incompressible, hydraulically opening the check valves during the reciprocating pump stroke, a gas is compressible. Thus, gas located between the traveling check valve and the standing check valve can merely compress during the down stroke without generating sufficient pressure to open the traveling valve. No liquid is then admitted above the valve to be lifted during the up stroke and the pump is gas locked. This problem is aggravated in large bore pumps, where considerably more internal volume is available for gas accumulation, with concomitant low pressurization during compression.

In the past, it has been suggested to remedy such gas-locking condition by preventing gas from reaching the pump. One way this was accomplished by using an annulus below the pump inlet. However, in order to implement such a remedy, accurate data is required about the generally unknown formation characteristics. Furthermore, the fluid reservoir characteristics of such formations change with time, requiring constant adjustments to the pump installations.

Applicant has found that the annulus method of preventing gas from reaching the pump is neither practical nor effective.

Such failure to completely fill the chamber is attributed to various causes. In a gas lock situation or a gas interference situation, the formation produces gas in addition to liquid. The gas is at the top of the chamber, while the liquid is at the bottom, creating a liquid-to-gas interface. If this interface is relatively high in the chamber, gas interference results. In gas interference, the plunger (on the downstroke) descends in the chamber and hits the liquid-to-gas interface. The change in resistances causes a mechanical shock or jarring. Such a shock damages the pump, the sucker rods and the tubing.

If the liquid-to-gas interface is relatively low in the chamber, gas lock results, wherein insufficient pressure is built up inside of the chamber on the downstroke to open the plunger valve. The plunger is thus not charged with fluid and the pump is unable to lift anything. A gas locked pump, and its associated sucker rods and tubing, may experience damage from the plunger hitting the interface.

In a pump off situation, the annulus surrounding the tubing down at the pump has a low fluid level, and consequently a low fluid head is exerted on the barrel valve. In an ideal pumping situation, when the plunger is on the upstroke, the annulus head pressure forces annulus fluid into the chamber. However, with a pump off condition, the low head pressure is unable to force enough fluid to completely fill the chamber. Consequently, the chamber has gas or air (a vacuum) therein. A pump (and its associated equipment) that is in a pump off condition suffers mechanical shock and jarring as the plunger passes through the liquid-to gas interface. A restricted intake can also cause pump off.

Accordingly, there is still a need for means to effectively deal with gas-locking in downhole reciprocating pumps.

As set forth above, there are a number of problems that are regularly encountered during oil pumping operations. Oil that is pumped from the ground is generally impure, and includes water, gas, and impurities such as sand. The presence of gas in the oil can create during pumping operations a condition that is sometimes referred to as "gas lock." Gas lock occurs when a quantity of gas becomes trapped between the travelling valve and standing valve balls. In this situation, hydrostatic pressure from above the travelling valve ball holds it in a seated position, while the pressure from the trapped gas will hold the standing valve ball in a seated position. With the balls unable to unseat, pumping comes to a halt with reduction or cessation of liquid production and other related issues including dry stuffing box failures.

One typical response to gas lock is to remove the oil pump and release the trapped gas. This can be time-consuming and, of course, interrupts pumping operations.

Another approach is to adjust the stroke of the plunger to bottom out, or tap bottom, jarring the balls of the travelling and standing valves off of their valve seats to attempt to influence liquid flow when hydrostatic conditions under gas-locking are unfavorable. The adjustment of the pump requires a service visit and the extent of the tap is not always appreciated at surface when the impact actually occurs one or more kilometers downhole. Further it is understood that rather than have service personnel return multiple times in response to repeated gas-locking, a pump might actually be left configured to tap bottom continuously. The usual result is damage to the sucker rods, rod guides, pump plunger and barrel.

SUMMARY

Using embodiments disclosed herein reciprocating pump efficiency is improved, with increased production and reduced maintenance. Production is increased as gas-locking is reduced or when it occurs is quickly overcome to resume liquid production. Maintenance is reduced through elimination of the damaging technique of tapping bottom, mitigating damage to valve balls, cages and seats. Rod life is increased through the reduction in rod slap.

Lazy operation of prior art travelling valves, in gas-locking situations, is overcome using a pre-valve that is positively actuated to incrementally compress fluids in the pump chamber below the travelling valve and improve the effectiveness of fluid uptake during each cycle, until such time as sufficient pressure is developed to open the travelling valve against hydrostatic pressure thereabove. The pre-valve is operational, not by mere differential pressures thereacross, but by a drag sleeve, actuated by the mechanical motion of the plunger to which it is attached. Accordingly, the pre-valve is not dependent upon differential pressures thereacross to open. Each cycle, by sealably retaining at least a portion of compressed gassy fluids in the pre-valve on each upstroke, the volumetric effectiveness of the pump's upstroke is improved for drawing incremental charges of fluid into the pump chamber and incremental increases in pump chamber pressure until the travelling valve opens and normal pumping resumes In one broad aspect, a method of overcoming gas-lock is provided comprising, on the downstroke, compressing gassy fluid in the pump chamber and opening a downhole chamber valve between the pump chamber and a staging chamber located at a downhole end of the travelling valve for receiving at least a portion of the compressed and gassy fluid therein, and on the upstroke, closing the downhole chamber valve for sealably retaining the at least a portion of compressed and gassy fluid therein while drawing an increment of fluid through the standing valve into the pump chamber. One continues repeating subsequent downstroke and upstroke cycles wherein on each downstroke, a pressure of the compressed gassy fluid in the pump chamber increases until it exceeds the hydrostatic head uphole of the travelling valve for resumption of normal fluid pumping. In an embodiment, the staging chamber is part of a pre-valve connected to and movable with the travelling valve. Accordingly, the compressing of the gassy fluid in the pump chamber and opening a downhole chamber valve between the pump chamber and a staging chamber further comprises: on the downstroke, driving a mandrel downhole and shifting a sleeve movable thereon by dragging the sleeve along the barrel for opening the downhole chamber valve to charge the staging chamber with gassy fluid, and on the upstroke, driving the mandrel uphole and shifting the sleeve movable thereon by dragging the sleeve along the barrel for closing the downhole chamber valve for charging the pump chamber through the standing valve.

In another aspect, anti gas-locking apparatus for overcoming gas lock comprises a pre-valve fluidly connected at a downhole end of the travelling valve the pre-valve, a pre-valve fluidly connected at a downhole end of the travelling valve the pre-valve having a staging chamber having an outlet in fluid communication to the travelling valve and an inlet for fluid communication with the pump chamber below the pre-valve when open and a chamber valve at the inlet, actuated between open and closed positions by dragging against the barrel for shifting on the downstroke, to open the inlet to the staging chamber for receiving at least a portion of the charge of fluid in the pump chamber; and on the upstroke, to close the chamber valve to close the inlet to the staging chamber and retain the at least a portion of the charge of fluid therein.

In an embodiment the pre-valve further comprises a mandrel having an uphole end mounted to a downhole end of the travelling valve, a downhole valve end, the staging chamber being formed therebetween, the staging chamber being in fluid communication through the uphole end to the travelling valve and the chamber valve further comprises a drag sleeve located concentrically about the mandrel and movable therealong between the uphole end on the downstroke and a downhole end on the upstroke.

In one embodiment, the pre-valve's mandrel has a bore therealong forming the staging chamber; and the inlet further comprises ports through the mandrel to the bore, the ports located adjacent and uphole of the downhole valve end and being alternatively uncovered by the sleeve to open the ports on the downstroke for fluid communication between the pump chamber and the bore upon the downstroke, and sealably covered by the sleeve to close the ports on the upstroke.

In another embodiment, the pre-valve's staging chamber is formed in an chamber annulus between the mandrel and the drag sleeve; the uphole end having passages therethrough between the annulus and the travelling valve; and the downhole valve end further comprises an annular downhole stop, wherein the downhole end of the drag sleeve alternately engages the annular downhole stop for sealably blocking the chamber annulus to close the downhole chamber valve on the upstroke, and being spaced therefrom for opening the chamber annulus adjacent the downhole valve end for fluid communication between the pump chamber and the chamber annulus upon the downstroke.

BRIEF DESCRIPTION OF THE DRAWINGS

FIG. 1A is a cross-sectional view of a downhole reciprocating insert rod pump having an anti-gas lock pre-valve installed therein;

FIGS. 1B and 1C are a side-by-side disassembled view of the pump according to FIG. 1A having the plunger, travelling valve and pre-valve of FIG. 1C shown separated from the barrel and standing valve of FIG. 1B;

DESCRIPTION OF THE PREFERRED EMBODIMENTS

Figure 2A:
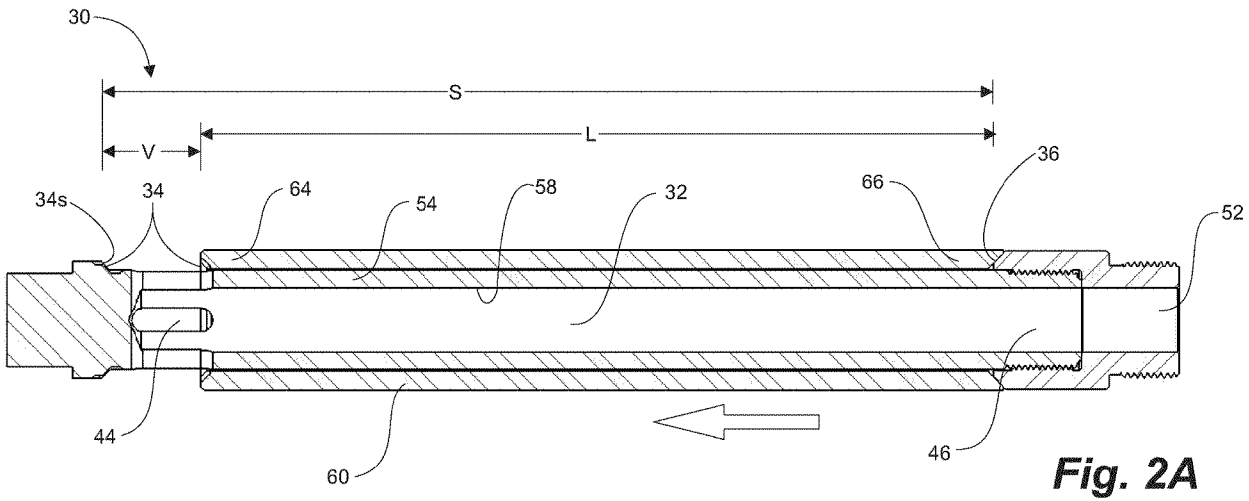
FIG. 2A is a cross-sectional view of an embodiment of the pre-valve in the downstroke position with the staging chamber inlet open in the flow-through position.

With reference to FIGS. 1A, 1B and 1C, a typical reciprocating plunger pump 10 comprises a barrel 12, typically about 20 feet in length, fluidly connected to the bore of a tubing string (not shown) extending from a hydrocarbon formation and uphole to surface, the barrel 12 having a standing valve 14 at a bottom or downhole end. A plunger 16, in the order of about four or five feet in length, has a travelling valve 18 at a downhole end thereof. As is conventional, the pump 10 is secured in the tubing string with either or both a top or bottom hold-down 19 between the pump 10 and a seating nipple in the tubing string. Further, the hold-down 19 seals the pump 10 within the tubing string.

Simply, a fluid pump has barrel 12 and the plunger 16 within that reciprocates uphole on an upstroke to draw a charge of fluid from the formation into a pump chamber 17, to charge the pump barrel 12 with fluid, and downhole on a downstroke to transfer the fluid into the hollow plunger 16 for lifting to surface in subsequent pump cycles. The pump chamber 17 of the barrel 12 receives the charge of fluid through the standing valve 14 at a downhole end thereof, and the plunger 16 receives fluid from the pump chamber 17 through the travelling valve 18 at a downhole end thereof.

With reference to FIG. 1C, the plunger 16 is connected through a top plunger adapter 20 to a valve rod 22 and a valve rod bushing 23, which is in turn connected to a rod string (not shown) extending to surface for imparting reciprocating motion of the plunger 16 within the barrel 12. The top plunger adapter 20 mechanically connects the plunger 16 to and valve rod 22. As shown in FIG. 1A, the valve rod 22 extends through a valve rod guide 25 attached to a top of the pump barrel 16, and directs fluid from a bore of the plunger 16 to an annulus between the valve rod 22 and pump barrel 12. Fluid passes up and out through the valve rod guide 25 and into the tubing string. Reciprocation of the plunger 16 alternatively draws a charge or increment of fluid, through the standing valve 14, into the pump chamber 17 of barrel 12, on an upstroke, and out of the pump chamber 17 on a downstroke. On the downstroke, the fluid increment transfers through the travelling valve 18 into the plunger, out through the top plunger adapter and into the annular area between the valve rod 22 and the barrel 12, and out through the valve rod guide 25 into the tubing string above the pump 10, ready for lift to surface on the upstroke of the next pumping cycle.

Herein, embodiments of an anti-gas lock apparatus or pre-valve are provided, supplemental to the travelling valve 18, for mitigating the effects of free gas and foaming. The pre-valve manages gassy fluids in the pump chamber 17 downhole of the travelling valve 18.

With reference to FIGS. 1A, 1C and FIGS. 2A and 2B, a pre-valve 30 is installed to a travelling valve 18 of an otherwise usual configuration of a standard pump 10 for overcoming gas lock. As shown in FIG. 3A, the pre-valve 30 is connected to, and below, the standard traveling valve 18 such as through threaded connection or other arrangement.

Figure 2B:
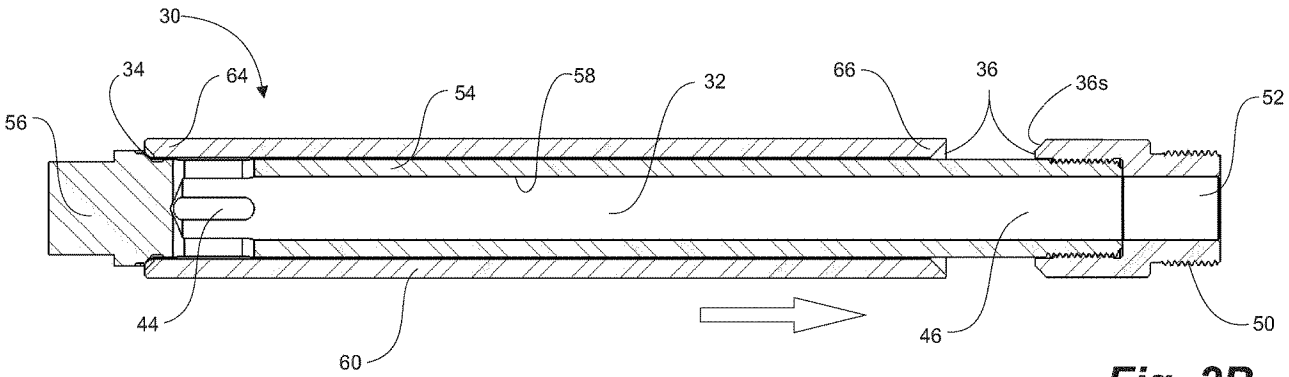
FIG. 2B is a cross-sectional view of the pre-valve of FIG. 2A in the upstroke position with the staging chamber inlet closed in the lift position.
Figure 3A:
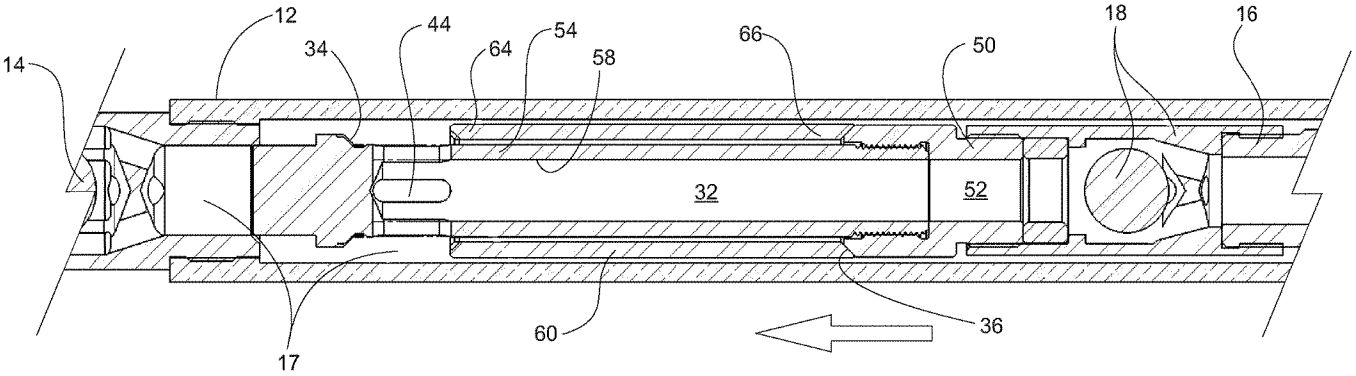
FIG. 3A is a cross-sectional view of the pre-valve of FIG. 2A installed in the pump barrel and actuated in the downstroke position with the staging chamber inlet and travelling valve open in the flow-through position.

In a first pre-valve embodiment, best shown in FIGS. 2A and 2B, the pre-valve 30 has a staging chamber 32 open at an uphole end 50 for fluid communication to the travelling valve 18 and is alternately openable and closeable at a downhole valve end 56 at chamber valve 34. The staging chamber 32 has an open or flow-through mode (FIG. 2A) and a closed, or lift mode (FIG. 2B). In this embodiment, the chamber valve 34 is the primary element affecting alternating flow-through and lift modes and is located a downhole valve end 56. As discussed, the uphole end 50 is adapted for connection to a downhole end of the travelling valve 18. The staging chamber 32 is in fluid communication with the travelling valve 18 through passage 52.

The staging chamber 32 extends between the uphole end 50 and the downhole chamber valve 34.

Figure 3B:
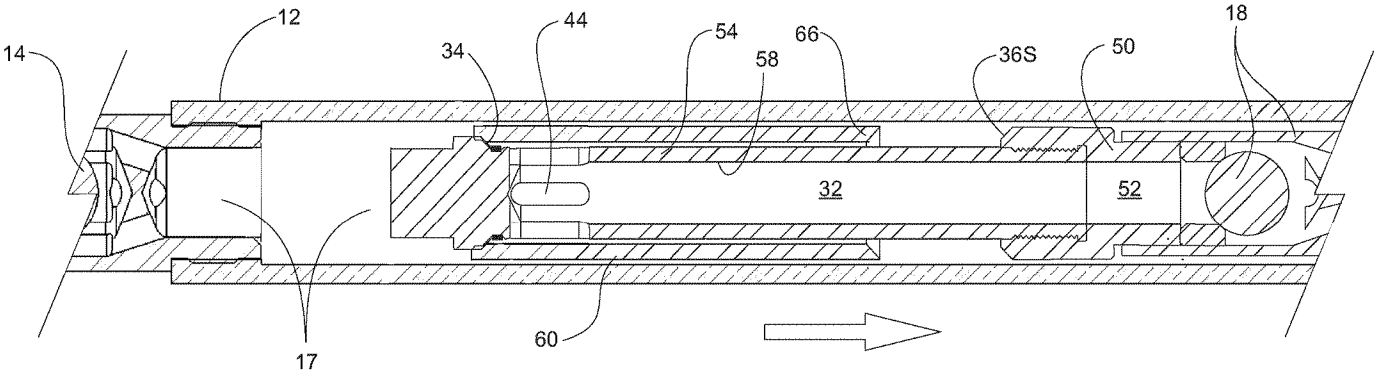
FIG. 3B is a cross-sectional view of the pre-valve of FIG. 2A installed in the pump barrel and actuated in the upstroke position with the staging chamber inlet and travelling valve closed in the lift position.

With reference to FIGS. 2B and 3B, during an upstroke, in the lift mode, the downhole chamber valve 34 closes, isolating a downhole port or inlet 44 of the staging chamber 32 from fluid in the pump chamber 17 therebelow while an uphole discharge 46 of the staging chamber 32 remains in fluid communication with the travelling valve 18 thereabove. During a downstroke, in a flow-through mode, the downhole chamber valve 34 opens the downhole inlet 44 of the staging chamber to the pump chamber 17 therebelow, while the uphole discharge 46 of the chamber 32 remains in fluid communication with the travelling valve 18 thereabove.

In other words, the pre-valve 30 has a staging chamber 32 having an outlet in fluid communication to the travelling valve 18 and an inlet for fluid communication with the pump chamber when open. The chamber valve at the inlet is actuated between open and closed positions by dragging against the barrel for alternately opening and closing the inlets. On the downstroke, the chamber valve 34 opens the inlet 44 to the staging chamber 32 for receiving fluid from the pump chamber 17; and on the upstroke, to close the chamber valve 34 to close the inlet 44 to the staging chamber and retain fluid therein.

In the flow-through mode, the pre-valve 30 encroaches on the volume or charge of fluid in the pump chamber 17 between the pre-valve 30 and the standing valve 14. As discussed below the downhole chamber valve 34 opens to enable staging chamber 32 to receive at least a portion of the fluid charge from the pump chamber 17. If the fluid is primarily liquid then the incompressible liquid passes through staging chamber 32 and, as is the case in conventional operation, opens the travelling valve against the hydrostatic head thereabove for pumping an increment of liquid uphole next pump cycle. However, if the fluid is gassy and somewhat compressible, then the staging chamber receives at least some fluid in a compressed state between the standing valve 14 and the closed travelling valve 18.

The gassy nature of the fluid compromises the normal compression and increase in pressure in the chamber 32, and accordingly, pressure changes may be insufficient to overcome the hydrostatic head above the closed travelling valve 18, the travelling valve therefore remaining closed. Regardless, there is a staged or localized compression of the fluid charge in the staging chamber 32.

On the next upstroke, in lift mode, with the downhole chamber valve 34 closed, at least a measure of the compressed fluid charge remains retained in the staging chamber 32 in a compressed state, now "staged" between the travelling valve 18 and the downhole chamber valve 34 and therefore increasing the opportunity for drawing additional fluid into the pump chamber 17.

Each cycle of the flow-through and lift mode cycles results in an incremental increase in the competency and pressure of the fluid charge in the pump chamber 17, and staging chamber 32, until such time as the pressure in the pump chamber 17 is sufficient to open the travelling valve 18 on a subsequent downstroke. In practice, this occurs in several pump downstroke and upstroke cycles. Accordingly, the travelling valve 18 is then enabled to actuated to open and operate as intended, receiving its increment of fluid for subsequent lifting to surface, without need for tapping or other gas-lock mitigation techniques.

The downhole chamber valve 34 is positively actuated to open and close through reciprocation the plunger 16 and pre-valve 30 attached thereto.

In FIGS. 2A and 2B, the pre-valve 30 comprises a mandrel 54 extending between the uphole end 50 and the downhole valve end 56. The mandrel 54 further comprises the staging chamber 32, in fluid communication with the travelling valve at the uphole valve end 50, and having the downhole chamber valve 34 at the downhole valve end 56 for alternately opening and closing fluid communication between the staging chamber 32 and the barrel 12 between the pre-valve 30 and the standing valve 14.

In this embodiment, the mandrel 54 has a bore 58 extending axially therethrough for forming the staging chamber 32. The downhole inlet 44 to the staging chamber 32 is formed through one or more ports though the mandrel 54 to access the bore 58. The inlet 44 extends between the bore 58 and the pump chamber 17. The inlet 44 is located adjacent, and uphole, of the downhole valve end 56.

In this embodiment, the positive actuation of the downhole chamber valve 34 is enabled using a drag sleeve 60 fit concentrically about the mandrel 54 and axially movable therealong. The chamber valve 34 is actuable through shifting the sleeve 60 to uncover the inlet on the downstroke for fluid communication between the pump chamber 17 and the bore 58 upon the downstroke, and shifting the sleeve 60 to sealably cover the inlet 44 on the upstroke.

The sleeve 60 has a downhole end 64 and an uphole end 66. The sleeve 60 is sized to be movable along in the barrel 12 yet to frictionally or viscously drag therein for alternating displacement along the mandrel 54 between and an annular shoulder or uphole stop 36*s* and an annular downhole stop 34*s*. The sleeve 60 is movably fit to the barrel 12 however is sized to viscously drag therealong, lagging movement of the pre-valve as it is reciprocated uphole and downhole, the shifting of the sleeve acting to open and close the downhole chamber valve 34. The downhole chamber valve 34 is formed of the corresponding angled, hardened, and polished or lapped surfaces at the downhole stop 34*s* and downhole end 64 of the sleeve 60.

A spacing S between the downhole and uphole stops 34*s*, 36*s* is greater than a length L of the sleeve, the difference or clearance V enabling alternate covering, or closing, and uncovering, or opening, of the downhole inlet 44. The downhole end 64 of the sleeve 60 downhole alternately engages and disengages from the downhole stop 34*s* for closing and opens the downhole chamber valve 34 respectively. The downhole chamber valve 34 opens and closes the staging chamber 32 for receiving at least a compressed portion of the charge of fluid from the barrel 12 on the downstroke, and closing the staging chamber 32 to the barrel on the upstroke.

As shown also in FIG. 3A, in the flow-through mode, a downhole movement of the plunger 16, and attached travelling valve 18, lowers the pre-valve's mandrel 54. The sleeve 60 drags in the barrel, lagging behind the downhole movement of the mandrel 54, shifting relative to the mandrel, the uphole end 66 of the sleeve 60 engaging the uphole stop 36*s*. The uphole end 66 and uphole stop 36*s* can form an uphole valve 36, increasing the effective length of the plunger 16 by the length S of the sleeve 60. Shifted, the downhole end 64 of the sleeve is spaced sufficiently, a clearance V, from the downhole stop 34*s* to open the chamber downhole inlet 44, enabling flow-through of the fluid from pump chamber 17 into the staging chamber 32. As shown in FIG. 3A, if the fluids therein are sufficiently gas-free, the travelling valve 18 opens as well for flow-through to the plunger 16.

As shown in FIG. 3B, during the lift mode on the upstroke, the mandrel 54, being connected to the plunger 16, also moves uphole. The sleeve 60 drags on the barrel 12 and lags moving uphole, shifting relative to the mandrel 54, the downhole end 64 engaging the downhole stop 34*s* and sealing thereto for capturing or retaining the compressed fluid in the staging chamber 32. In this embodiment, the downhole chamber valve 34 is operable through alternating sealing and unsealing of the sleeve's downhole end 64 and the downhole stop 34*s*. The uphole end 66 of the sleeve 60 is spaced clearance V from the uphole stop 36*s*. Due to plunger-like the clearances of the sleeve 60 to the barrel 12 any impetus to flow from the chamber 32 and along between sleeve and mandrel, is restricted by the sleeve/barrel interface and therefor minimized.

Figure 4A:
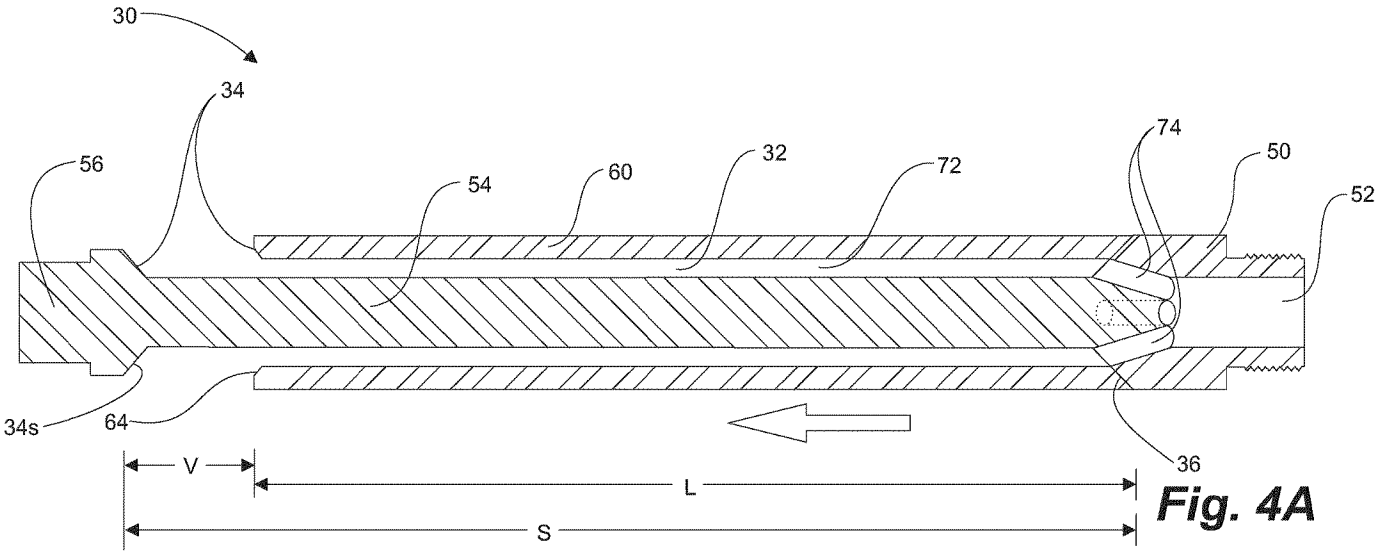
FIG. 4A is a cross-sectional view of another embodiment of the pre-valve in the downstroke position with the annular staging chamber inlet open in the flow-through position.
Figure 4B:
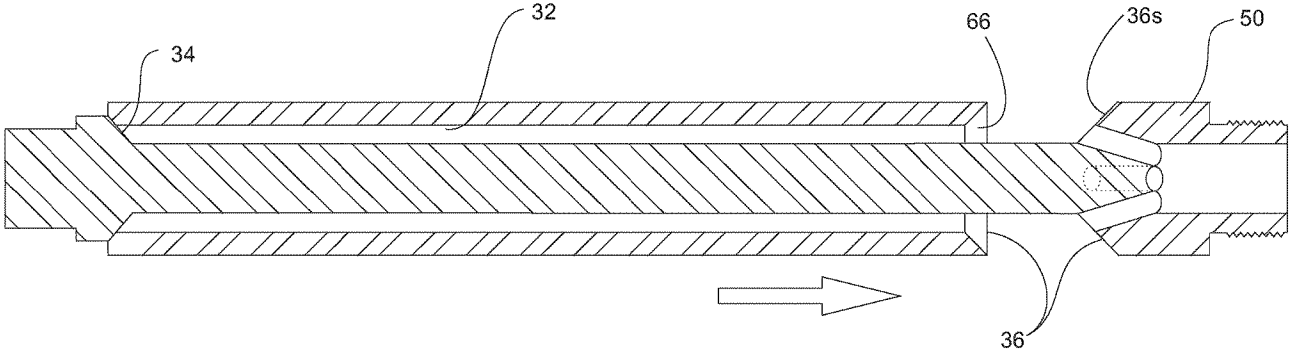
FIG. 4B is a cross-sectional view of the pre-valve of FIG. 4A in the upstroke position with the annular staging chamber inlet closed in the lift position.

Turning to an alternate embodiment of the pre-valve 30, best shown in FIGS. 4A and 4B, the staging chamber 32 is formed in an annulus 72 between the sleeve 60 and the mandrel 54. The passage 52 is now includes or is in fluid communication with one or more cross-over ports 74 through uphole end 50 and extending between the annulus 72 and the travelling valve 18. The uphole stop 36*s* and the uphole end 66 of the sleeve 60 now form the uphole chamber valve 36. As both an uphole end 50 and a downhole valve end 56 of the annulus alternately opens and closes as the sleeve 60 moves axially, the uphole chamber valve 36 ensures the flow-through mode fluidly connects the pump chamber 17, below the pre-valve 30, to the travelling valve 18.

Figure 5:
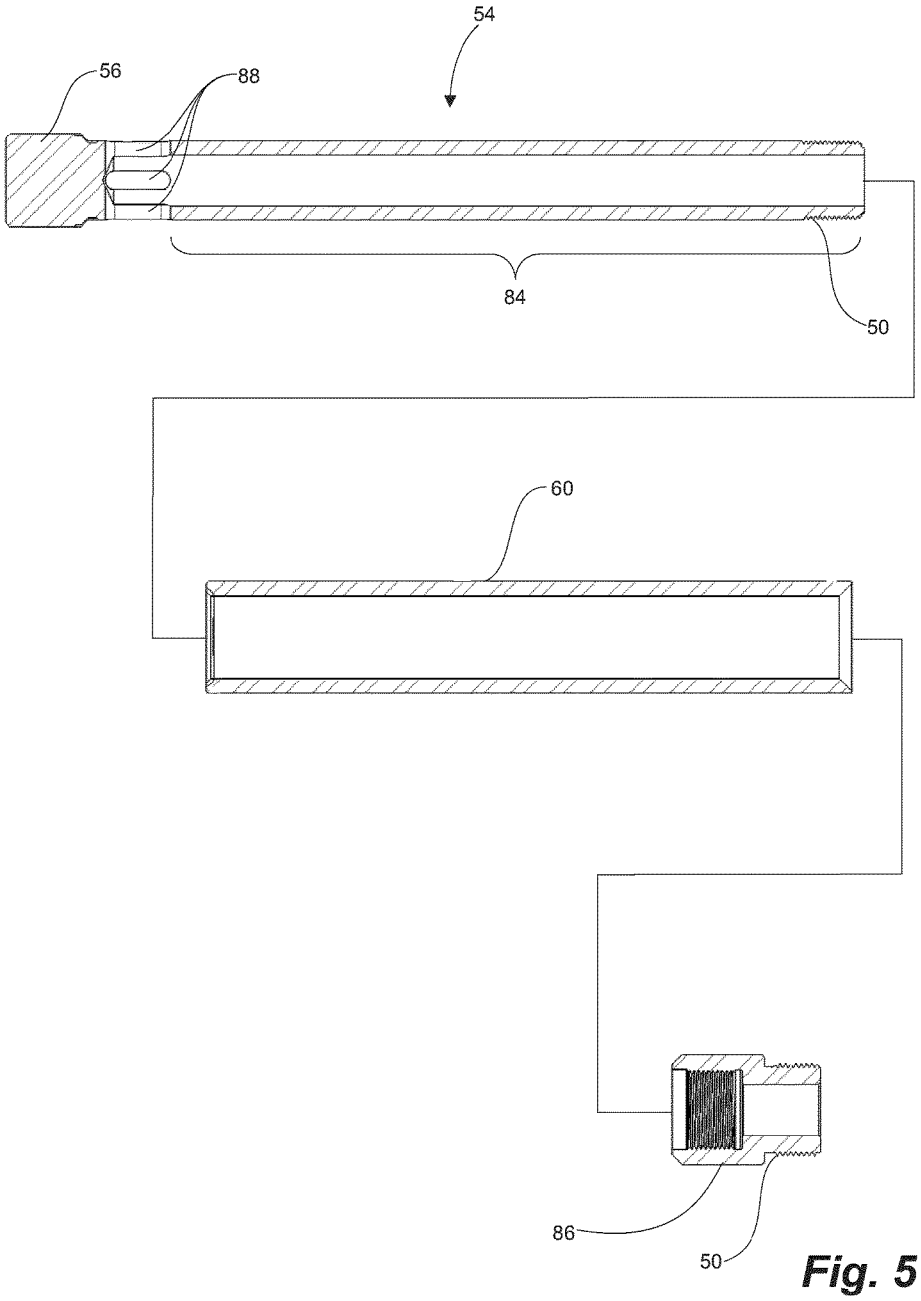
FIG. 5 is an exploded, disassembled cross-sectional view of three components of an embodiment of the pre-valve according to FIG. 2A having an uphole end for post-sleeve installation, threaded assembly with the mandrel.

With reference to FIGS. 2A, 2B and 5 the pre-valve 30 comprises: the ported mandrel 54 having a uphole end 50 and a downhole valve end 56. Sleeve 60 is fit slidably along a middle section 84 of the mandrel 56. The mandrel's uphole and downhole valve end 50, 56 are spaced sufficiently to enable the sliding sleeve 60 to move back and forth thereon. To facilitate installation of the sleeve 60, one of the uphole end 50 or downhole valve end 56 is removably secured to the mandrel 54. As shown, in one embodiment of FIG. 5, the downhole valve end 56 is integrated with the mandrel's middle section 84 and the uphole end 50 is comprises a cap 86 removably and threadably connected to the mandrel 54 and is further fit for connection, such as by threaded connection, to mate with the downhole end of the plunger's traveling valve 18.

Further, like the sleeve 60, the uphole end 50 has an outside diameter (OD) similar to that of the standard plunger that is sized to fit the barrel 12. The OD of the middle section 84 of the mandrel 54 is sized to allow for a clearance between mandrel and an inside diameter of the sliding sleeve 60. The chamber's inlet 44 comprises one or more ports 88 adjacent the downhole valve end 56. In an embodiment, the inlet 44 comprises four ports 88 are shown are machined through middle section 84 adjacent downhole valve end 56. The downhole stop 34*s* is hardened with Stellite® or other hard material and subsequently lapped or polished. The downhole end 64 of the shiftable sleeve for sealing against the downhole stop 34*s* and can be similarly hardened with Stellite® or other hard material lapped or polished.

Normal Pump Operation—No Gas—Lock

As with prior art systems, substantially gas-free fluids such as liquid oil is pumped from a wellbore through a series of "downstrokes" and "upstrokes" of the pump 10, which motion is imparted by an above-ground pumping unit.

During the upstroke, the travelling valve 18 and pre-valve 30 are lifted with the plunger 16 while friction or drag, created as a result of the close tolerances between inside of the pump barrel 12 and the outside of the sliding drag sleeve 60, causes the sleeve 60 to shift and close the downhole chamber valve 34. The standing valve 14 opens, and plunger suction and formation pressure permits liquid to flow into pump chamber 17 below the pre-valve 30. This liquid is temporarily held in place between the standing valve 14 and the traveling valve 18. The hydrostatic weight of the liquid to surface keeps the traveling valve 18 closed.

During the normal downstroke, as the plunger 16 and pre-valve 30 travel downwards, the standing valve 14 closes, and as liquids cannot be compressed, the oil is forced up through the pre-valve 18 and through the traveling valve 18 into the hollow plunger 16 for lifting towards surface next pump cycle. Again, frictional force or viscous drag causes the sleeve to shift up to engage the uphole stop 36*s*, a 45 degree angular portion of the uphole end 50 of the mandrel 54. The clearance between the downhole stop 34*s* and the sleeve 60 opens the multi-ported fluid inlet 44. The decreasing volume of the pump chamber forces liquid through into the ports 44 and up the staging chamber 32, and through the open traveling valve 18 to joining previously displaced fluid in the plunger 16 to flow through the plunger 16, out of the top plunger adapter 20, and through the valve rod guide 25 into the tubing string.

In the case of gassy fluids, the travelling valve 18 does not open reliably, previously resulting in gas lock, with the prior art arrangements applying repeated cycles struggling to build sufficient pressure to open the travelling valve 18.

Gas Interference

The pre-valve 30 overcomes the limitations of the conventional travelling valve. As before, during the upstroke, and due substantially to the hydrostatic head, the standard traveling valve 30 closes, and due to the drag on the shifting sleeve 60, the downhole pre-valve 30 closes. As the pre-valve 30 continues to be dragged upwardly, a pressure drop in the pump chamber 17 causes the standing valve 14 to open and formation fluid, such as gassy oil, is drawn into pump chamber 17.

During the downstroke, when gas-locking often presents, as the plunger 16 and attached pre-valve 30 travel downhole, the standing valve 14 closes. However with gassy liquids, unlike normal operation with non-compressible liquids, the traveling valve 18 may not open, but could stay closed as a result of the minimal rise in pressure of the compressible gas or gassy liquids being insufficient to overcome the hydrostatic head of the liquid above the traveling valve 18. In the prior art pump, the charge of gassy liquid in pump chamber 17 merely recompresses. However, using pre-valve 30, the gas-lock recompression cycle is broken. As a result of drag, the sleeve 60 shifts, the downhole chamber valve 34 opens and gassy liquid in the pump chamber is at least somewhat compressed. The inlets 44 open for actuating the entirely of the staging chamber and pump chamber 17 to receive compressed or recompressed fluids within the diminishing volume between standing valve 14 and the travelling valve 18. While compressed, the resulting pressure is not yet high enough to open the travelling valve 18.

During the next or subsequent upstroke, the pre-valve 30 changes the behavior of the pump chamber refilling cycle. The sleeve 60 shifts to close the downhole chamber valve 34, trapping a portion of the compressed fluids therein and thereby reducing the effective volume of the pump chamber 17 therebelow. A like pump stroke, having a smaller effective volume results in a more vigorous suction and filling impetus. Substantially only the volume between the pre-valve's downhole valve end 56 and the standing valve 14 is effective or active. The standing valve 14 opens and at least an additional increment of gassy fluid or liquid is drawn into pump chamber 17 below the pre-valve 30. Compressed gassy liquid is retained in the pre-valve while suction is enhanced therebelow. Minimal fluid bleeds out the uphole end of the staging chamber between the sleeve 60 and the barrel 12.

Thus, on each subsequent downstroke, the additional fluid drawn into the pump chamber 17 is incrementally increases the pressure in the pump chamber 17 until the travelling valve 18 opens and normal pump resumes. The cycle of upstroke and downstroke is repeated, and at each cycle the staging chamber withholds a portion of the compressible gassy liquids from the pump chamber permitting another increment of fluid to be drawn into the pumping chamber 17 through the standing valve 14. While the traveling valve 18 may stay closed for a number of cycles, the fluid eventually compresses to a pressure on the travelling valve that exceeds the hydrostatic weight of the column of liquid thereabove.

Ideally close spacing is desirable between the downhole chamber valve 34 and the standing valve 14, as shown in FIG. 3A, arranged to approach as close as possible together without contact.

Accordingly, within a few cycles the pre-valve 30 corrects the gas-locked condition and normal pumping resumes. This may happen a few or many times in the course of a day but only does so when required to overcome gas-locking, the balance of the operation continuing to pump as a conventional does The operation is automatic in that pumping operation continues whether there are gassy liquids or not. When gassy liquids are encountered, the pump continues stroking while the pre-valve commences clearing the gassy liquid from the pump. This may take several cycles.

An example pump having a 1.5 inch ID barrel 12 might have a plunger 16 fit with a one foot long pre-valve 30 installed at a downhole end thereof. Thus, a typical five foot long plunger might be swapped out for a four foot long plunger, plus one foot of pre-valve, for retaining an effective 5 foot long plunger length. The pre-valve's drag sleeve 60 can be about 8 inches long having about a 1 inch travel or clearance V between uphole and downhole stops 36*s*, 34*s* for opening and closing the downhole chamber valve 34. The sleeve 12 can have an OD of about 1.495 having about a 0.003 inch clearance to the barrel 12.

For the pre-valve embodiment of FIGS. 2A, 2B and 5, four 0.25 wide by 0.875 inch long ports form the inlet 44 alternately exposed and blocked as the sleeve 60 opens and closes. Sleeve 60 can have an ID of 1.035 inches being slidably movable over a mandrel OD of 1 inch, the mandrel 54 having a bore ID of 0.75 inches.

The mandrel 54 and sleeve 60 can be manufactured of 316 stainless steel (SS) or the like. In one embodiment, the sleeve is 304 SS while the mandrel is 316 SS. The sleeve 60 can also be conveniently manufactured from otherwise conventional pump plunger stock, having the same dimensions as a plunger 16 employed in a like-sized pump 10. As stated, the sleeve 60 can be an otherwise conventional, spray metal oil pump plunger stock modified to be bored out and machined to length and to accommodate the mandrel. The specifications and types of spray metal coatings can adhere to API Specification 11AX, for plunger outside surface condition and base core hardness. In the case of the hollow mandrel of FIGS. 2A and 2B, the bore 58 can be formed using gun-drilling techniques.

The uphole and downhole stops 36*s* and 34*s* respectively, can be hardened with vanadium carbide or made of a tool steel such as a high air hardening, high-carbon, high-chromium steel ANSI D-2 material possessing high wear resisting properties for maximum wear resistance. In another embodiment, the downhole stop 34*s* is modified for severe metal-to-metal service. Stellite® is suitable for high impact and wear resistance and is applied to the downhole stop 34*s* such as by plasma or electric-arc welding and machined to form the sealing surface.

Turing to FIG. 5, to facilitate assembly and in particular, installation of the drag sleeve 60 to mandrel 54, either end of the mandrel is assembled with a removable upset such as a cap 86 to form one of either the uphole or downhole stop 36*s*, 34*s* and retain the sleeve 60 for slidable movement over the middle section 84. In an embodiment, the downhole valve end 56 of the mandrel 54 is integral with the mandrel and the cap 86 at the uphole end 50, is threadably connected the mandrel once the sleeve has been fit concentrically thereto. The cap 86 is also threadably connected to a downhole end of the travelling valve.

The embodiments of the invention for which an exclusive property of privilege is claimed are define as follows:

1. An anti gas-locking apparatus in a pump positioned in a subterranean wellbore, the pump, having a barrel forming a pump chamber and a reciprocating plunger positioned therein, the plunger reciprocating uphole on an upstroke and downhole on a downstroke, and the pump having at least one standing valve in fluid communication with a downhole inlet end of the barrel, for receiving a charge of fluid from the subterranean wellbore into the pump chamber, and at least one traveling valve in fluid communication with a downhole inlet end of the plunger, the pump further comprising:

a pre-valve forming a staging chamber, and having:

a downhole inlet end having a chamber valve for receiving at least a portion of the charge of fluid from the pump chamber into the staging chamber; and an uphole outlet end fluidly connected at a downhole end of the at least one travelling valve, the pre-valve comprising:

a reciprocating mandrel operatively connected to the plunger, the mandrel having a first uphole annular stop and a second downhole annular stop, and forming a space between the first and second annular stops; and a shifting sleeve, having a length, located concentrically about the mandrel and moveable therealong between the first and second annular stops;

wherein, on the downstroke, the sleeve shifts uphole to open the chamber valve, and on the upstroke, the sleeve shifts downhole to close the chamber valve; and wherein the space between the first and second annular stops is greater than the length of the sleeve, and the chamber valve is formed in the clearance between the length of the shifting sleeve and the space between the first and second annular stops.

2. The apparatus of claim 1 wherein:

the uphole end of the mandrel is mounted to a downhole end of the at least one travelling valve, wherein the staging chamber being in the mandrel is in fluid communication with the travelling valve.

3. The apparatus of claim 2 wherein:

on the downstroke, the uphole shift of the sleeve opens the chamber valve by uncovering an inlet for fluid communication between the pump chamber and the staging chamber and, on the upstroke, the downhole shift of the sleeve closes the chamber valve to sealably cover the inlet.

4. The apparatus of claim 3 wherein:

the mandrel forms a bore therealong forming the staging chamber; and the inlet further comprises ports through the mandrel to the bore.

5. The apparatus of claim 3 wherein:

the staging chamber is formed in an chamber annulus between the mandrel and the shifting sleeve;

the uphole end has passages therethrough between the annulus and the travelling valve; and the downhole valve end further comprises an annular downhole stop, wherein the downhole end of the shifting sleeve alternately engages the annular downhole stop for sealably blocking the chamber annulus to close the chamber valve on the upstroke, and being spaced therefrom for opening the chamber annulus adjacent the downhole valve end for fluid communication between the pump chamber and the chamber annulus upon the downstroke.

6. A method of overcoming gas-lock in a pump positioned in a subterranean wellbore, the pump having a barrel forming a pump chamber and a reciprocating plunger positioned therein, the plunger reciprocating uphole on an upstroke and downhole on a downstroke, and the pump having at least one standing valve in fluid communication with a downhole inlet end of the barrel, for receiving a charge of fluid from the subterranean wellbore into the pump chamber, and at least one traveling valve in fluid communication with a downhole inlet end of the plunger, the method comprising:

providing a pre-valve having a downhole inlet end forming a chamber valve in fluid communication with the pump chamber, for receiving the charge of fluid from the pump chamber into a staging chamber formed therein, and having an uphole outlet end in fluid communication with the at least one traveling valve for discharging fluid from the pre-valve staging chamber through the at least one traveling valve, the pre-valve comprising:

a mandrel operatively reciprocated with the plunger, the mandrel having a first uphole annular stop and a second downhole annular stop, and forming a space between the first and second annular stops, and a sleeve, having a length, located concentrically about the mandrel and movable therealong between the first and second annular stops, wherein the chamber valve is formed by the clearance between the length of the sleeve and the space between the first and second annular stops;

reciprocating the plunger uphole, shifting the sleeve downhole along the mandrel, closing the chamber valve and opening the at least one standing valve to receive the charge of fluid from the subterranean wellbore into the pump chamber;

reciprocating the plunger downhole, compressing the charge of fluid in the pump chamber, shifting the sleeve uphole along the mandrel, opening the chamber valve and receiving at least a portion of the charge of fluid from the pump chamber into the staging chamber;

reciprocating the plunger uphole, shifting the sleeve downhole along the mandrel, closing the chamber valve and sealably retaining the at least a portion of the charge of fluid within the staging chamber while reopening the at least one standing valve and drawing a further charge of fluid from the subterranean wellbore into the pump chamber;

reciprocating the plunger downhole, compressing the further charge of fluid in the pump chamber, shifting the sleeve uphole along the mandrel, opening the chamber valve and receiving at least a portion of the further charge of fluid from the pump chamber into the staging chamber; and repeatedly reciprocating the plunger uphole and downhole wherein on each downstroke, a pressure of the charge of fluid received in the pump chamber increases until it exceeds the hydrostatic head uphole of the at least one travelling valve, opening the at least one traveling valve for normal fluid pumping.

7. The method of overcoming gas-lock of claim 6, wherein, on the downstroke, the sleeve shifts uphole along the mandrel to open inlets into the chamber valve; and on the upstroke, the sleeve shifts downhole along the mandrel to close the inlets into the chamber valve.

8. The method of overcoming gas-lock of claim 6, wherein, on the downstroke, the sleeve shifts uphole along the mandrel by dragging along the barrel; and on the upstroke, the sleeve shifts downhole along the mandrel by dragging along the barrel.

9. The method of overcoming gas-lock of claim 8 wherein the staging chamber is formed in a bore of the mandrel, further comprising on the downstroke, opening the chamber valve for fluid communication between the pump chamber and the mandrel's bore, the bore being in fluid communication with at least one the travelling valve.

10. The method of overcoming gas-lock of claim 8 wherein the staging chamber is formed in a chamber annulus between the mandrel and the sleeve, further comprising on the downstroke, opening the chamber valve for fluid communication between the annulus, the annulus being in fluid communication with the travelling valve.

* * * * *